US006735320B1

(12) United States Patent
Gertner, Jr.

(10) Patent No.: US 6,735,320 B1
(45) Date of Patent: May 11, 2004

(54) ANGLED PORT LOUDSPEAKER

(76) Inventor: Stephen J. Gertner, Jr., 1725L Troxell Ct., Allentown, PA (US) 18103

( * ) Notice: Subject to any disclaimer, the term of this patent is extended or adjusted under 35 U.S.C. 154(b) by 1826 days.

(21) Appl. No.: 08/621,215

(22) Filed: Mar. 25, 1996

Related U.S. Application Data

(63) Continuation of application No. 08/422,779, filed on Apr. 17, 1995, now abandoned, which is a continuation of application No. 08/063,136, filed on May 17, 1993, now abandoned.

(51) Int. Cl.[7] ..... H04R 1/02; H04R 1/20

(52) U.S. Cl. ..... 381/349; 381/345; 381/348; 381/338

(58) Field of Search ..... 381/150, 156, 381/153, 199, 188, 160, 96, 158, 192, 193, 205, 337, 338, 339, 345, 353, 354, 372, 396, 346, 348; 181/154, 155, 163

(56) References Cited

U.S. PATENT DOCUMENTS 2,801,704 A * 8/1957 Martin ..... 181/144
4,146,111 A * 3/1979 Mae et al. ..... 181/154
4,146,744 A * 3/1979 Veranth ..... 381/89
5,173,575 A * 12/1992 Furukawa ..... 181/156

FOREIGN PATENT DOCUMENTS

JP 59-94992 A * 5/1984 ..... 381/158
JP 5-199581 * 8/1993 ..... 381/158

* cited by examiner

*Primary Examiner*—Rexford Barnie
(74) *Attorney, Agent, or Firm*—Adams & Wilks

(57) ABSTRACT

A loudspeaker comprises an enclosure including a bottom wall, a front wall extending upwardly from the bottom wall, and a rear wall extending upwardly from the bottom wall and opposite the front wall and having an angled wall portion facing generally upwardly and rearwardly. At least one speaker is mounted on the front wall in a given plane to direct sound waves outwardly therefrom and at least one passive device is mounted on the angled wall portion to direct sound waves generally upwardly and rearwardly of the given plane.

37 Claims, 2 Drawing Sheets

ANGLED PORT LOUDSPEAKER

This is a continuation application of Ser. No. 08/422,779 filed Apr. 17, 1995 now abandoned which is a continuation application Ser. No. 08/063,136 filed May 17, 1993 now abandoned.

BACKGROUND OF THE INVENTION

The present invention relates to a loudspeaker and, in particular, to a loudspeaker which is enhanced for clarity and improved response.

Loudspeakers are known in the art and examples of known loudspeakers are shown in FIGS. 1 and 2. Conventional loudspeakers have the problem of requiring enhancement of the clarity of the bass coming from inside the non-sealed cabinet or enclosure. As shown in FIGS. 1 and 2, ports are typically provided in the front or back of the enclosure, but always in a plane parallel to the plane of the speaker and/or the plane of a nearby surface, such as a wall or bookcase. This leads to added distortion.

With conventional front porting, as shown in FIG. 2, bass waves emanating from a front port 7 of an enclosure 5 are in negative phase with those of a bass driver 6, causing a cancellation effect at the instant a note is played. Since there is some delay between arrival of the two waves, it actually ends up being only a delayed bass note coming from the port 7. This provides some additional bass extension but at a loss of clarity, making the bass sound muddy.

With conventional rear porting, as shown in FIG. 1, a bass driver 2 faces forward and the phase is correct, but distortion problems are created by wave reentry into a rear port 3 due to reflection from the facing wall W and by standing waves formed behind the enclosure 1. These cause peaks and dips in the bass and result in a rumbling, boomy bass.

Another disadvantage of the prior art loudspeakers is the fact that there is no ability to control the bass output, specifically to reduce unwanted sound waves from coming through the port. The bass output is controlled only on a limited basis by the length and size of the port as determined by conventional formulas.

In conventional loudspeakers, under normal tuning conditions, the placement of the port at a set distance from the driver, in combination with the volume of the port, determines the tuning characteristics. The rules are varied since cabinet or enclosure dimensions and driver characteristics are varied, but since the port is still in a parallel plane with the driver being tuned, the reflections inside the enclosure will still provide an undesirable amount of pass through of unwanted higher frequencies leading to midrange distortion.

SUMMARY OF THE INVENTION

A main object of the present invention is to provide a more controlled approach to enhancing bass output from loudspeakers in a non-sealed enclosure.

Another object of the present invention is to enhance the clarity and improve the response in loudspeakers.

These and other objects and advantages of the present invention are achieved in accordance with the present invention by placing the port at an angle to the driver so that sound waves created by the driver can be tuned additionally by the direction of the angle which is now also a monitor of pressure level. Lower bass components contain more pressure than upper frequencies and will be allowed through the porting. However, higher and less desirable frequencies will remain in the enclosure to be continually dampened by internal insulation, of which much less is required than in conventional systems.

In accordance with the present invention, the direction of the angle of the port can be used to control the bass output. For more release of the upper notes, the port is directed at the center of the driver or speaker. For greater release of lower notes, the port is directed at the edge of the speaker cone, and for the deepest bass enhancement, the port is moved away from the cone or the steepness of the angle is increased.

Two primary enhancements result from this improvement according to the present invention. The first is the ability to fine tune bass waves created in a passive manner. The second is the reduction of standing waves on the back or rear side of the enclosure and the reduction of both phase and midrange distortion at the front of the enclosure. Both of these together create more accurate bass and improved clarity.

The angled output can be any passive device used to enhance bass, when angled in a manner which may take advantage of tuning due to the direction and angle relative to the driver being tuned.

A passive device consists of either a port or a passive radiator. A port includes an open area such as a tube which is sized in length and diameter to allow certain bass waves through. A passive radiator works in the same manner, however it uses a non-active speaker cone chosen by size and weight to select bass waves. In a particularly preferred embodiment of the present invention, ports are used for the added efficiency and for better control of frequency selection.

The angled output can be any passive device used to enhance the clarity of speakers. The port is angled in a manner which is related to the frequencies being tuned to. The angle causes the reduction of standing waves behind the enclosure and/or wave cancellation or distortion of waves caused by the port tuning in relation to sound emanating from the front of the enclosure.

The loudspeaker in accordance with the present invention comprises an enclosure including a bottom wall, a front wall extending upwardly from the bottom wall, and a rear wall extending upwardly from the bottom wall and opposite the front wall and having an angled wall portion which faces generally upwardly and rearwardly. At least one speaker is mounted on the front wall in a given plane to direct sound waves outwardly therefrom. At least one passive device is mounted on the angled wall portion to direct sound waves generally upwardly and rearwardly of the given plane.

The angled wall portion is preferably disposed at an angle of 30° to 60° with respect to the given plane and in a particularly preferred embodiment, the given plane comprises the front wall.

These and other features and advantages of the present invention will be described in more detail in the following detailed description of the invention taken with the attached drawings, wherein:

DETAILED DESCRIPTION OF THE INVENTION

Figure 1:
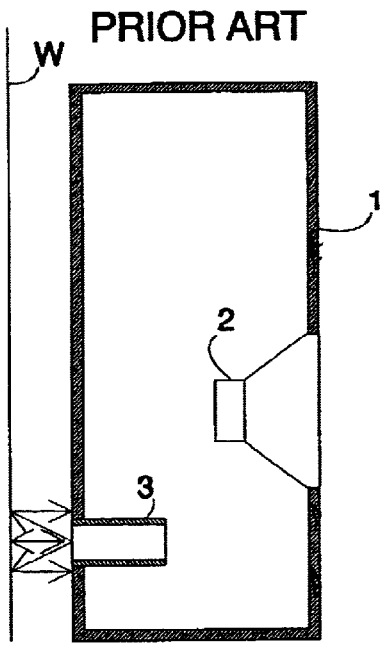
FIG. 1 is a sectional view of a conventional rear port loudspeaker.
Figure 2:
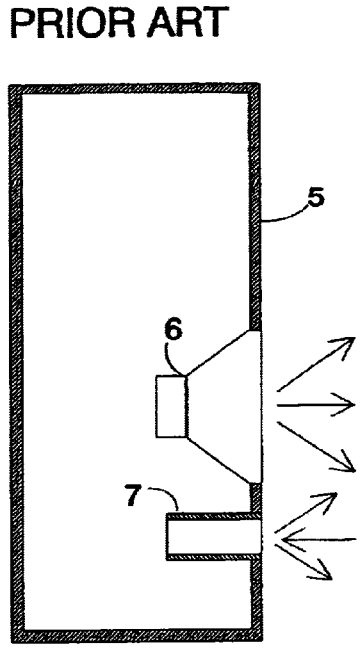
FIG. 2 is a sectional view of a conventional front port loudspeaker.
Figure 3:
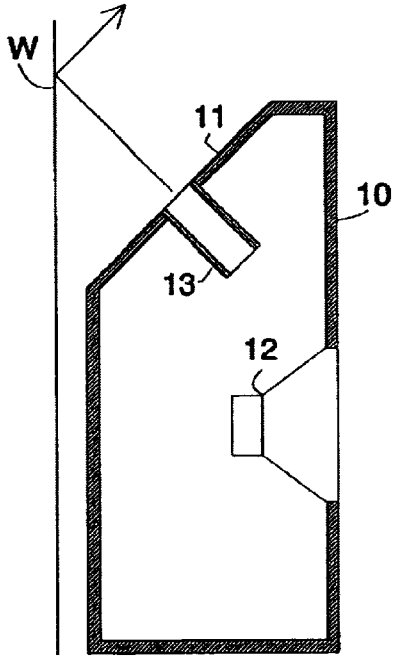
FIG. 3 is a sectional view of one embodiment of a loudspeaker according to the present invention.
Figure 7:
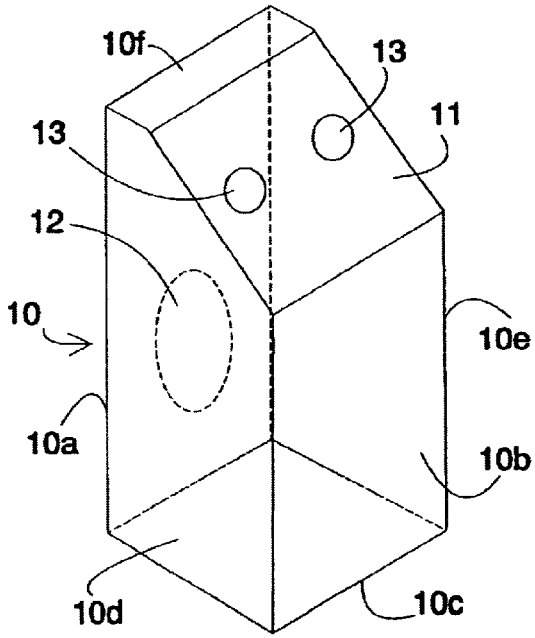
FIG. 7 is a perspective view of the embodiment of FIG. 3.

Referring to FIGS. 3 and 7, the loudspeaker according to the present invention comprises an enclosure 10 made of wood or other suitable material and having a front wall 10*a* extending upwardly from a bottom wall 10*c*, a rear wall 10*b* extending upwardly from the bottom wall 10*c* and two side walls 10*d* and 10*e*. Extending between the rear wall 10*b* and a topwall 10*f* is an angled wall portion 11 which is disposed at an angle to the front wall 10*a* of between 10° and 80° and preferably between 30° and 60°. The front wall 10*a* defines a given plane in which at least one speaker or bass driver 12 is mounted for directing sound waves outwardly of the enclosure 10.

Figure 4:
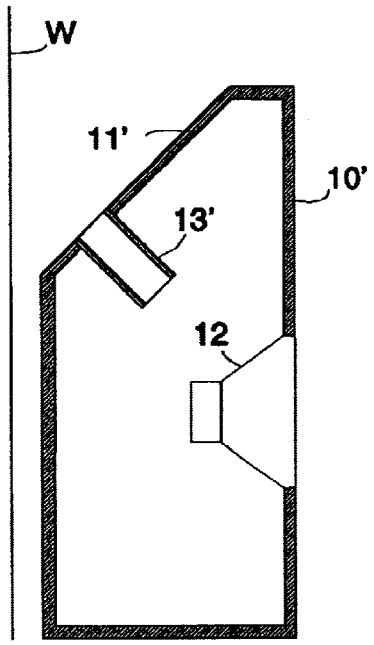
FIG. 4 is a sectional view of a second embodiment of the present invention.
Figure 5:
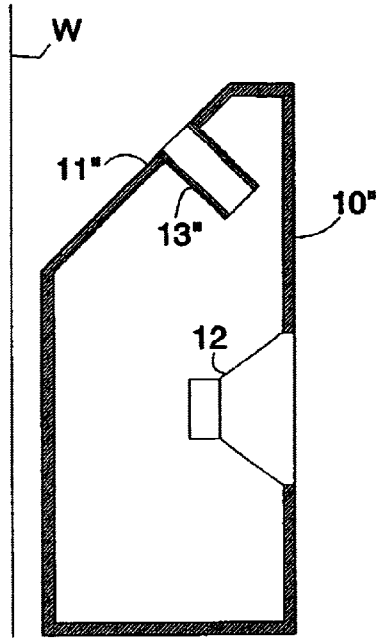
FIG. 5 is a sectional view of a third embodiment of the present invention.

Disposed in the angled wall portion 11 are two ports 13 which, in the embodiments of FIGS. 3–5, comprise open tubes mounted in holes in the angled wall portion 11. The angled wall portion 11 faces generally upwardly and rearwardly of the given plane, which is coplanar with the front wall 10, so that it directs sound waves generally upwardly and rearwardly of the front wall 10*a*. These sound waves are directed upwardly and forwardly when they are reflected by a facing wall W disposed behind the enclosure 10.

In the embodiment shown in FIG. 3, the port 13 is directed along a predetermined axis towards an edge of the speaker cone of the speaker or bass driver 12 to increase the release of lower notes from the enclosure 10. In this embodiment, the port 13 comprises a tube having a longitudinal axis directed towards the edge of the speaker 12.

In the embodiment shown in FIG. 4, the port 13 in the angled wall portion 11' of the enclosure 10' extends along a predetermined axis in a direction towards the center of the cone of the speaker 12 in order to have increased release of the upper notes. In this embodiment, the port 13' comprises a tube having a longitudinal axis directed towards the center of the speaker 12.

In the embodiment shown in FIG. 5, the port 13" is mounted on angled wall portion 11" of the enclosure 10" and extends along a determined axis away from the cone of the speaker 12 in order to obtain the deepest bass enhancement. In this embodiment, the port 13" comprises a tube having a longitudinal axis which is directed away from the speaker 12.

Figure 6:
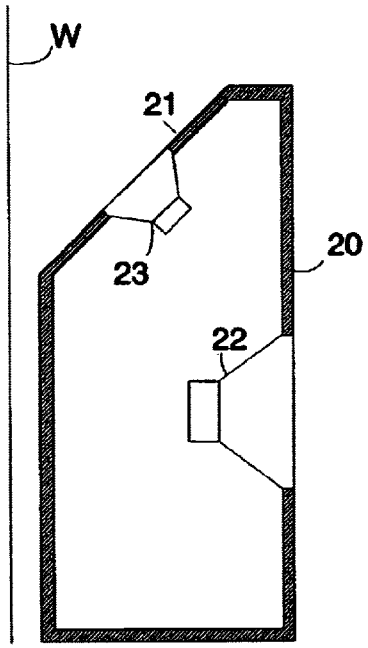
FIG. 6 is a sectional view of a fourth embodiment of the present invention.

FIG. 6 illustrates an enclosure 20 having an angled wall portion 21 with a passive radiator 23 for selecting bass waves from a speaker or bass driver 22. In this embodiment, the passive radiator 23 comprises a non-selecting bass waves from a speaker or bass driver 22. In this embodiment, the passive radiator 23 comprises a non-active speaker.

As shown in the drawings, two ports are mounted in the angled wall portion. However, it is recognized by those of skill in the art that one or more ports as well as one or more drivers may be utilized in the loudspeaker.

In the embodiments shown in FIGS. 3–6, the passive device terminates substantially flush with the angled wall portion of the enclosure and is arranged to direct sound waves produced within the enclosure outwardly in a direction generally normal to the face of the angled wall portion.

It is also noted that the insulation used within the enclosure is not shown for the sake of clarity, however those skilled in the art will recognize that the use of insulation as well as the relative dimensions of the speakers, ports and enclosure can be selected without any undue experimentation.

It will be appreciated that the instant specification and claims are set forth by way of illustration and example and not limitation and that various modifications may be made without departing from the spirit and scope of the present invention.

What is claimed is:

1. A loudspeaker comprising: an enclosure including a bottom wall, a front wall extending upwardly from the bottom wall, and a rear wall extending upwardly from the bottom wall and opposite the front wall and having an angled wall portion facing generally upwardly and rearwardly; at least one speaker mounted on the front wall in a given plane to direct sound waves outwardly therefrom; and at least one passive device disposed on the angled wall portion to direct sound waves produced within the enclosure outwardly in a direction generally normal to the face of the angled wall portion so that all of the sound waves are unobstructed by any other structure disposed directly above or connected to the enclosure, the at least one passive device extending into the interior of the enclosure along a predetermined axis with respect to the at least one speaker, the predetermined axis being selected to effect selective tuning of undampened sound waves emanating directly from the at least one speaker.

2. A loudspeaker according to claim 1, wherein the angled wall portion is disposed at an angle of 30–60 degrees with respect to the given plane.

3. A loudspeaker according to claim 1, wherein the given plane comprises the front wall.

4. A loudspeaker according to claim 1, wherein the passive device comprises a port.

5. A loudspeaker according to claim 4, wherein the port comprises an open tube mounted on the angled wall portion of the rear wall.

6. A loudspeaker according to claim 5, wherein the tube has a longitudinal axis directed towards an edge of the at least one speaker.

7. A loudspeaker according to claim 5, wherein the tube has a longitudinal axis directed towards a central portion of the at least one speaker.

8. A loudspeaker according to claim 5, wherein the tube has a longitudinal axis directed away from the at least one speaker.

9. A loudspeaker according to claim 1, wherein the passive device comprises a passive radiator.

10. A loudspeaker according to claim 1, wherein the rear and front walls extend perpendicularly upwardly from the bottom wall, and wherein the angled wall portion is disposed at an angle of 30–60 degrees with respect to the front wall.

11. A loudspeaker according to claim 1; wherein the at least one passive device terminates substantially flush with the angled wall portion.

12. A loudspeaker according to claim 1; wherein the predetermined axis is directed towards an edge of the at least one speaker.

13. A loudspeaker according to claim 1; wherein the predetermined axis is directed towards a central portion of the at least one speaker.

14. A loudspeaker according to claim 1; wherein the predetermined axis is directed away from the at least one speaker.

15. A loudspeaker comprising: an enclosure including a bottom wall, a front wall extending upwardly from the bottom wall, and a rear wall extending upwardly from the bottom wall and opposite the front wall and having an angled wall portion facing generally upwardly and rearwardly; at least one speaker mounted on the front wall to direct sound waves outwardly therefrom; and at least one passive device mounted on the angled wall portion and extending interiorly into the enclosure along a predetermined axis directed towards an edge of the at least one speaker, the predetermined axis being selected to effect selective tuning of undampened sound waves emanating directly from the at least one speaker.

16. A loudspeaker according to claim 15; wherein the predetermined axis is selected in relation to the angle of the angled wall portion to reduce formation of standing waves behind the rear wall of the enclosure.

17. A loudspeaker according to claim 15; wherein the at least one passive device terminates substantially flush with the angled wall portion.

18. A loudspeaker according to claim 1; wherein the angled wall portion is not contained within the enclosure.

19. A loudspeaker according to claim 1; wherein the angled wall portion defines an exterior part of the enclosure.

20. A loudspeaker according to claim 1; wherein the passive device is inflexible.

21. A loudspeaker according to claim 1; wherein angled wall portion extends generally parallel to a surface of the at least one speaker.

22. A loudspeaker according to claim 15; wherein the angled wall portion is not contained within the enclosure.

23. A loudspeaker according to claim 15; wherein the angled wall portion defines an exterior part of the enclosure.

24. A loudspeaker according to claim 15; wherein the passive device is inflexible.

25. A loudspeaker according to claim 15; wherein the angled wall portion extends generally parallel to a surface of the at least one speaker.

26. A loudspeaker according claim 1; wherein the angled wall portion defines an exterior part of the enclosure unbstructed by any other part of the enclosure so that the sound waves are directed to the exterior of the enclosure unobstructed by any part of the enclosure.

27. A loudspeaker according to claim 1; wherein the passive device comprises an open tube mounted on the angled wall portion of the rear wall and extending into the enclosure, the open tube having one end terminating substantially flush with the angled wall portion.

28. A loudspeaker according to claim 1; wherein the predetermined axis is selected in relation to the angle of the angled wall portion to reduce formation of standing waves behind the rear wall of the enclosure.

29. A loudspeaker according to claim 28; wherein the angled wall portion is disposed at an angle of 30–60 degrees with respect to the given plane.

30. A loudspeaker according to claim 15; wherein the angled wall portion defines an exterior part of the enclosure unbstructed by any other part of the enclosure so that the sound waves are directed to the exterior of the enclosure unobstructed by any part of the enclosure.

31. A loudspeaker according to claim 15; wherein the passive device comprises an open tube mounted on the angled wall portion of the rear wall and extending into the enclosure, the open tube having one end terminating substantially flush with the angled wall portion.

32. A loudspeaker according to claim 19; wherein the angled wall portion is not contained within the enclosure.

33. A loudspeaker according to claim 32; wherein the at least one passive device extends into the interior of the enclosure along a predetermined axis with respect to the at least one speaker, the predetermined axis being selected to effect selective tuning of undampened sound waves emanating directly from the at least one speaker.

34. A loudspeaker according to claim 33; wherein the predetermined axis is selected in relation to the angle of the angled wall portion to reduce formation of standing waves behind the rear wall of the enclosure.

35. A loudspeaker comprising: an enclosure including a bottom wall, a front wall extending upwardly from the bottom wall, and a rear wall extending upwardly from the bottom wall and opposite the front wall and having an angled wall portion facing generally upwardly and rearwardly; at least one speaker mounted on the front wall in a given plane to direct sound waves outwardly therefrom; and at least one open tube mounted on the angled wall portion to direct sound waves produced within the enclosure outwardly in a direction generally normal to the face of the angled wall portion, the at least one open tube extending into the interior of the enclosure along a predetermined axis directed towards an edge of the at least one speaker, the predetermined axis being selected to effect selective tuning of undampened sound waves emanating directly from the at least one speaker.

36. A loudspeaker comprising: an enclosure including a bottom wall, a front wall extending upwardly from the bottom wall, and a rear wall extending upwardly from the bottom wall and opposite the front wall and having an angled wall portion facing generally upwardly and rearwardly; at least one speaker mounted on the front wall in a given plane to direct sound waves outwardly therefrom; and at least one passive device disposed on the angled wall portion to direct sound waves produced within the enclosure outwardly in a direction generally normal to the face of the angled wall portion, the at least one passive device extending into the interior of the enclosure along a predetermined axis directed towards an edge of the at least one speaker, the predetermined axis being selected to effect selective tuning of undampened sound waves emanating directly from the at least one speaker.

37. A loudspeaker comprising: an enclosure including a bottom wall, a front wall extending upwardly from the bottom wall, and a rear wall extending upwardly from the bottom wall and opposite the front wall and having an angled wall portion facing generally upwardly and rearwardly; at least one speaker mounted on the front wall in a given plane to direct sound waves outwardly therefrom; and at least one passive device disposed on the angled wall portion to direct sound waves produced within the enclosure outwardly in a direction generally normal to the face of the angled wall portion, the at least one passive device extending into the interior of the enclosure along a predetermined axis with respect to the at least one speaker, the predetermined axis being selected to effect selective tuning of undampened sound waves emanating directly from the at least one speaker; wherein the angled wall portion defines an exterior part of the enclosure unobstructed by any other part of the enclosure so that all of the sound waves are directed to the exterior of the enclosure unobstructed by any part of the enclosure.

* * * * *